US006381766B1

(12) United States Patent
Perry

(10) Patent No.: US 6,381,766 B1
(45) Date of Patent: May 7, 2002

(54) SPA COVER REMOVAL APPARATUS AND METHOD

(76) Inventor: Gary L. Perry, 3325 W. Meadows La., Manhattan, MT (US) 59741

( * ) Notice: Subject to any disclaimer, the term of this patent is extended or adjusted under 35 U.S.C. 154(b) by 0 days.

(21) Appl. No.: 09/697,873

(22) Filed: Oct. 26, 2000

Related U.S. Application Data

(60) Provisional application No. 60/161,890, filed on Oct. 27, 1999.

(51) Int. Cl.[7] ..... E04H 4/06

(52) U.S. Cl. ..... 4/498; 4/503; 16/239; 16/332; 49/394

(58) Field of Search ..... 4/498, 500, 503; 49/394; 16/240, 241, 239, 331, 332, 327

(56) References Cited

U.S. PATENT DOCUMENTS

| | | | | |
|---|---|---|---|---|
| 4,853,985 A | | 8/1989 | Perry | |
| 4,857,374 A | | 8/1989 | Perry | |
| 4,991,238 A | | 2/1991 | Forrest | |
| 5,048,153 A | * | 9/1991 | Wall et al. | 4/498 X |
| 5,131,102 A | | 7/1992 | Salley et al. | |
| 5,471,685 A | | 12/1995 | Cross | |
| 5,517,703 A | | 5/1996 | Ouelette | |
| 5,566,403 A | | 10/1996 | Black et al. | |
| 5,584,081 A | | 12/1996 | Ouelette | |
| 5,634,218 A | | 6/1997 | Ouelette | |
| 5,644,803 A | | 7/1997 | Wilson | |
| 5,689,841 A | | 11/1997 | Black et al. | |
| 5,974,599 A | | 11/1999 | Tudor | |
| 5,996,137 A | | 12/1999 | Genova | |

OTHER PUBLICATIONS

Promotional information brochure by CEn Tech Corporation, Puyallup, WA 98372.

* cited by examiner

*Primary Examiner*—Gregory L. Huson
*Assistant Examiner*—Kathleen J. Prunner
(74) *Attorney, Agent, or Firm*—William G. Forster

(57) ABSTRACT

A spa cover removal apparatus includes a pivot frame assembly having a pair of elongate side arms spaced apart to receive opposing cover side surfaces between the same for rotatably supporting the spa cover. Fixed to the spa is a stationary base, for pivotally supporting the pivot frame assembly. For this purpose, the stationary base is disposed under the pivot frame assembly. This arrangement, enables the spa cover to shift from a first horizontal covering position over the spa, to a second stowed position adjacent the back side of the spa as a rearwardly directed force is applied to the spa cover. Accordingly, the spa cover moves rearward and pivots relative to the side arms while the pivot frame assembly simultaneously pivots relative to the stationary base, about a substantially horizontal base pivot axis. In addition, a slide lock bar extends from the pivot frame assembly for sliding attachment to the spa side to restrict the spa cover against further movement once the same reaches the second stowed position. In another aspect, a portion of the pivot frame assembly extends in a downward direction from the base pivot axis so that the pivot frame assembly can engage the stationary base for restricting further pivotal movement of the pivot frame assembly when the same moves to the second stowed position.

20 Claims, 4 Drawing Sheets

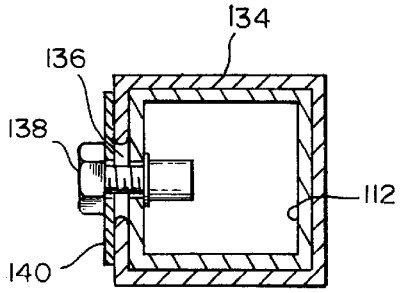
FIG. 3
FIG. 4
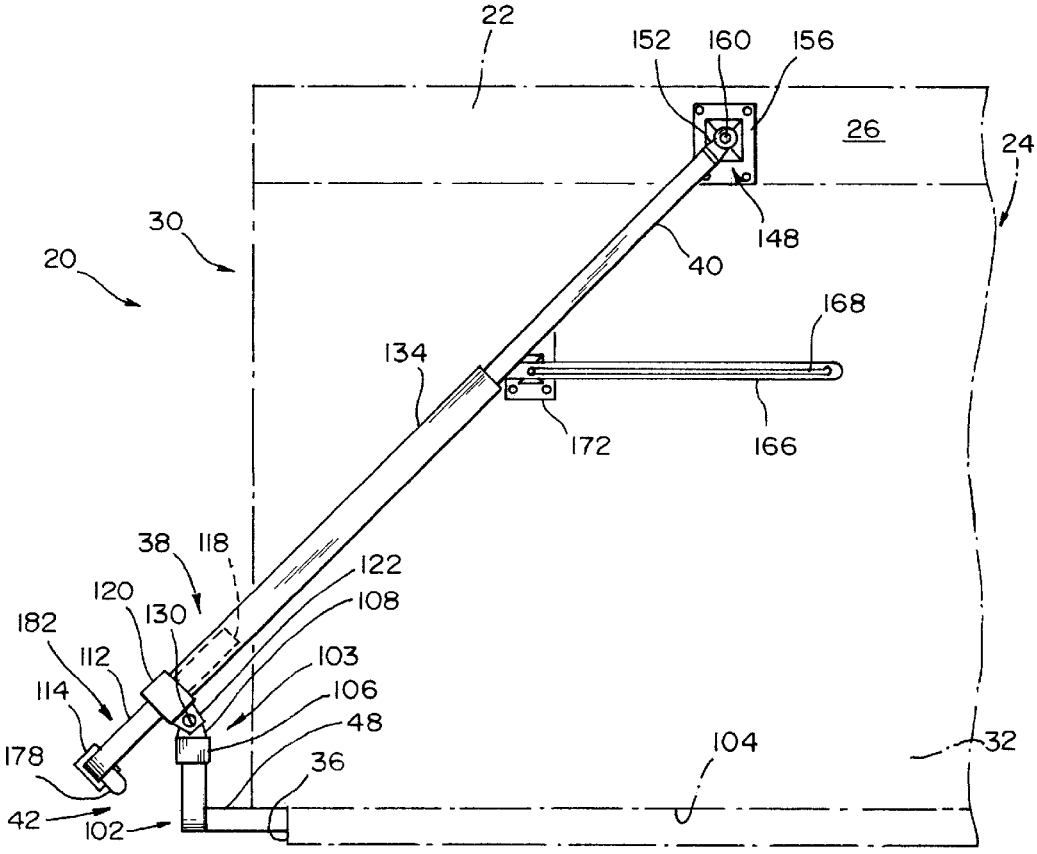

SPA COVER REMOVAL APPARATUS AND METHOD

This application claims the benefit of U.S. Provisional Application No. 60/161,890 filed Oct. 27, 1999.

BACKGROUND

This invention relates generally to hot tubs and spas, and more particularly to removal systems adapted for removing covers therefrom.

Spa cover removal systems and mechanisms are known in the art. Such mechanisms vary widely in complexity, ease of operation and cost of manufacturing. In recent years, the rise in popularity of spas, commonly referred to as hot tubs, has hastened the development of spa covers and removal apparatus therefor. One early design for cover removal is disclosed in U.S. Pat. No. 4,857,374 issued to Perry (Gary L.) in 1989. The Perry design employs gas springs that extend from the sides of a spa to a spa cover that is hinged to the rear of the spa. In this way, the gas springs assist the user to pivot the cover to a vertical position, away from the top of the spa.

U.S. Pat. No. 4,853,985 issued to Perry (Cliff R.) in 1989 shows a cover assembly for use with a spa. The cover assembly includes a cover member mounted for rotational movement to the spa structure by mounting arms. The mounting arms are arranged relative to the cover member so that the cover member travels along a path from a covering position to an open position. Additionally, the '985 device includes tension springs. Because of the arrangement of the mounting arms and their attachment to the spa cover, the design is not easily adaptable for use with spa covers that fold back to expose only a portion of the spa.

U.S. Pat. No. 4,991,238 issued to Forrest in 1991 shows a spa cover lift that includes one or more struts for positioning a movable frame adapted for pivotable attachment to the side of a spa. The lift includes apparatus for receiving a spa cover from the spa and retaining the cover adjacent the movable frame. The struts are operable to displace the movable frame to an extended position to provide a surface onto which a spa user can slide a spa cover. Because the Forrest device requires that the entire spa cover be moved rearward onto the movable frame, a single user could find it difficult to slide a large heavy cover.

U.S. Pat. No. 5,131,102 issued to Salley in 1992 shows a device for use in conjunction with a spa cover mounted for pivotal movement to facilitate the removal of the cover away from the vicinity of the spa when the same is in use. A bridge arm supported by two side arms is pivotally attached to a base. The bridge arm can be pivoted into position adjacent the spa cover. With the spa cover folded over, the bridge arm is pivoted clearly away from the spa. The arrangement of the '102 device is such that it provides support to the spa cover only at the cover's folding point during the removal process. Accordingly, a portion of the cover slides over the spa as a user operates the device to remove the cover.

U.S. Pat. No. 5,471,685 issued to Cross in 1995 shows a support for a cover of a hot tub spa having a pair of roller support arms, each having a pivotal connection for securing it to the spa. The pivotal connections each comprise an attachment member for mounting on a vertical outer wall of the spa, with a hinge connecting the support arm to its attachment member for pivotal movement between operative and inoperative positions. Like the Forrest device, the entire spa cover must be moved rearward onto the frame.

U.S. Pat. No. 5,517,703 issued to Ouelette in 1996 shows a lifting mechanism for removing and restoring a hinged spa cover from a spa tub. Two tubular brackets are cojoined so that base members on the brackets are aligned parallel, adjacent to one end of the spa, and arms on the brackets extend along opposite sides of the spa. The cojoined base members are pivotally mounted so that the lifting arms are rotatable between a first lowered position and a second raised position. Support beams are connected to the lifting arms over which the hinged sections of the cover are foldable when the arms are in the first position allowing the cover to be lifted clear of the spa when the arms are moved to the second raised position. Like the Salley device, the '703 cover removal apparatus, during the removal process, provides support to the spa cover only at the cover's folding point.

U.S. Pat. No. 5,584,081 issued to Ouelette in 1996 shows a lifting frame for a hinged spa cover having a pair of adjustable lifting arms pivotally mounted adjacent the side walls of a spa. A U-shaped foot actuated lever is connected to the lifting arms with the base of the lever extended across one end wall of the spa. The upper part of the arms are equipped with one or more supports that are adjacent to and parallel with the cover hinge whereby the cover is foldable over the support or supports when the lifting arms are in a first position. The foot lever is elevated when the lifting arms are in the first position, and depressing the lever causes the arms to be rotated to a second position whereby the folded cover is supported in a vertical position adjacent one end wall of the spa. Like the earlier Ouelette invention, the spa cover is supported only at its folding point.

U.S. Pat. No. 5,634,218 issued to Ouelette in 1997 shows a lifting frame for a hinged spa cover having a pair of adjustable lifting arms pivotally mounted on or adjacent to a side wall of a spa. The upper part of the arms are equipped with one or more supports that are adjacent to and parallel with the cover hinge with the cover being foldable over the support or supports when the lifting arms are in a first horizontal position. Rotation of the frame causes the folded cover to be rotated to a second, vertical position adjacent one end wall of the spa. Similar to the other Ouelette devices, this design provides support to the spa cover only at its folding point.

U.S. Pat. No. 5,644,803 issued to Wilson in 1997 shows a spa support assembly that is provided with a plurality of support arms having upper and lower ends with the lower ends pivotally attached to an external surface of the spa side wall for pivotal rotation of the upper ends of the support arms through an arc from a point above and adjacent to the side wall to a point away from the side wall at a point where the upper ends of the support arms are within the generally horizontal plane defined by the top surfaces of the side walls and at a distance away from the side wall. Like the prior '238 and '685 patents, the Wilson device requires that the user slide the spa cover rearward over the spa during the removal process.

While most of the above noted designs assist in the removal process of a spa cover from a spa, they typically do not provide a simple, safe, inexpensive and adjustable means to remove and support the spa cover in a compact position which allows unimpeded access to the spa. Accordingly, a need remains for a spa cover removal apparatus that facilitates the easy removal of a spa cover by a single user which is safe, and easy to install and use.

SUMMARY OF THE INVENTION

One object of the present invention is reduce the effort required to remove a spa cover from a spa.

A second object is to facilitate the removal of a spa cover from a spa by only one person.

Another object is to protect expensive spa covers by simplifying the removal process thereof from a spa.

Yet another object is to reduce the expense of heating water in spas by promoting the use of spa covers that are easily removed by one person.

A further object is to increase the safety of using a cover removal apparatus.

Still another object is to fully support a spa cover in a compact manner thereby minimizing the space taken by the stowed cover following the removal process.

The invention is a spa cover removal apparatus for assisting a person in the repositioning and removal of a spa cover from a spa. Typically, spa covers are constructed such that they include opposing left and right cover side surfaces. Additionally, spas are typically arranged to include a cabinet having a back side disposed between opposing left and right spa sides, wherein the back side is commonly disposed above a recessed spa base. In the present invention, the spa cover removal apparatus comprises a pivot frame assembly having a pair of elongate side arms spaced apart to receive opposing cover side surfaces between the same for rotatably supporting the spa cover. Fixed to the spa is a stationary base, for pivotally supporting the pivot frame assembly. For this purpose, the stationary base is disposed under the pivot frame assembly.

This arrangement enables the spa cover to shift from a first horizontal covering position over the spa, to a second stowed position adjacent the back side of the spa as a rearwardly directed force is applied to the spa cover. Accordingly, the spa cover moves rearward and pivots relative to the side arms while the pivot frame assembly simultaneously pivots relative to the stationary base, about a substantially horizontal base pivot axis. In addition, a slide lock bar extends from the pivot frame assembly for sliding attachment to the spa side to restrict the spa cover against further movement once the same reaches the second stowed position.

In another aspect of the invention, a portion of the pivot frame assembly extends in a downward direction from the pivot axis, in an opposing direction from the side arms. In this way, the pivot frame assembly can engage the stationary base for restricting further pivotal movement of the pivot frame assembly when the same moves to the second stowed position.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 3 is a cross sectional view taken along line 3—3 in FIG. 1 illustrating a slot tube disposed over a portion of a right corner tube.

FIG. 4 is a left side elevation view of a spa cover removal apparatus installed on a spa with a spa cover disposed in the first horizontal covering position over the spa.

DETAILED DESCRIPTION OF PREFERRED EMBODIMENT

Figure 1:
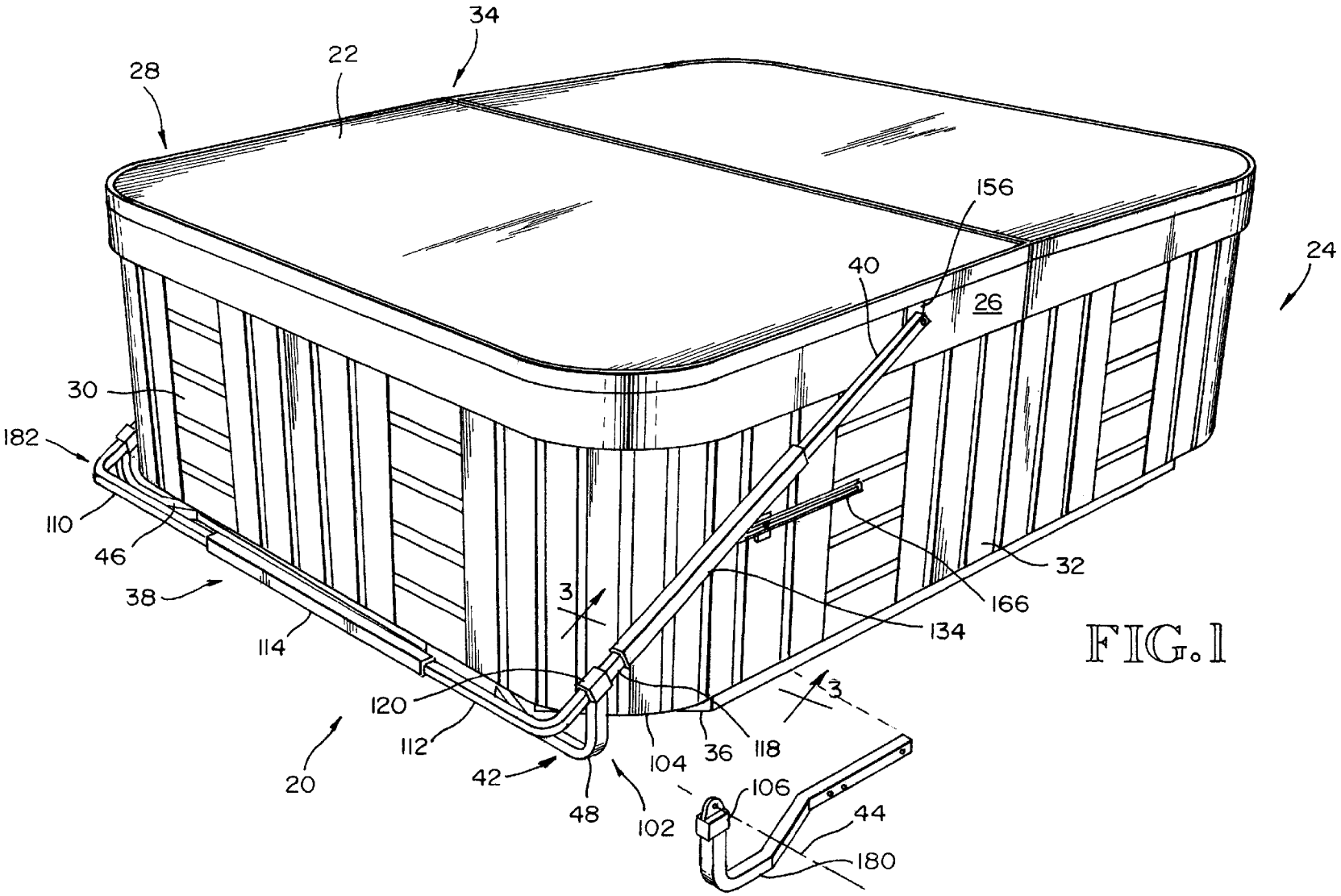
FIG. 1 is a rear perspective view of the preferred embodiment spa cover removal system/apparatus installed on a spa having a spa cover.

FIGS. 1 through 6 show a preferred embodiment of a spa cover removal apparatus 20. A spa cover removal apparatus 20 is provided for assisting a person or user (not illustrated) in the repositioning and removal of a spa cover 22 from a spa 24. Typically, a spa cover 22 is symmetrically constructed such that it includes opposing parallel left and right cover side surfaces 26, 28. Additionally, a spa 24 is typically arranged to include a back side 30 disposed between opposing left and right spa sides 32, 34, with the back side 30 being disposed above a recessed spa base 36. In the present invention, the spa cover removal apparatus 20 comprises a pivot frame assembly 38 having a pair of elongate side arms (only the side arm 40 is illustrated, the components of the opposing side being a mirror image) spaced apart to receive opposing cover side surfaces 26, 28 therebetween for rotatably supporting the spa cover 22. Fixed to the spa 24 is a stationary base 42 for pivotally supporting the pivot frame assembly 38. For this purpose, the stationary base 42 is disposed under the pivot frame assembly 38.

Importantly, this arrangement enables the spa cover 22 to shift from a first horizontal covering position over the spa 24, to a second stowed position adjacent the back side of the spa 24 as a rearwardly directed force is applied to the spa cover 22. It should be noted the spa cover 22 is in a folded condition when it moves from the first position to the second position. Accordingly, the spa cover 22 moves rearward and pivots relative to each side arm while the pivot frame assembly 38 simultaneously pivots relative to the stationary base 42, about a substantially horizontal base pivot axis 44.

Figure 2:
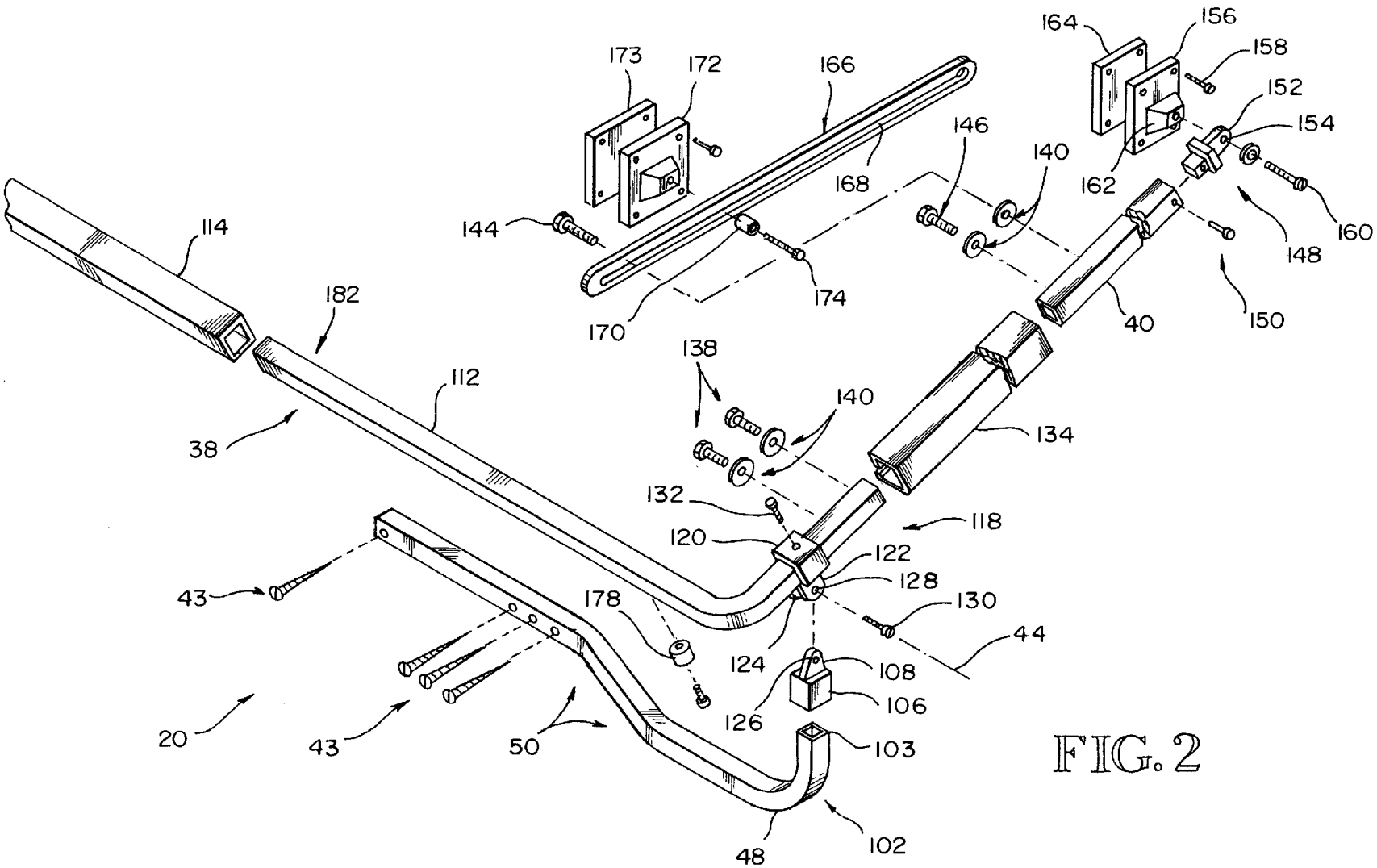
FIG. 2 is an exploded view of the left side of a spa cover removal apparatus, wherein the right side (not illustrated) is constructed as a mirror image thereof.

Considering now in more detail the structure of the components from which a spa cover removal apparatus 20 is constructed, a stationary base 42 is provided to pivotally support the pivot frame assembly 38. In the present invention, the stationary base 42 comprises a right base member 46, and an opposing left base member 48. Each base member is constructed as the mirror image of the other. Likewise, because the spa cover removal apparatus 20 is symmetrical, the components of the opposing left and right sides thereof are mirror images. Accordingly, a detailed illustration of only the components of the left side are given as illustrated in FIG. 2.

In the preferred embodiment, each base member 46, 48 is constructed from one inch square tubular aluminum bent to form an offset 50 of approximately 3.5 inches in a rearward direction from the spa 24, and an upward curve 102. For attachment to the spa, a plurality of lag bolts 43 are secured through the left base member 48, for example, while the same is positioned under the lip 104 formed by the recessed spa base 36. Additionally, the upward curve 102 is disposed so that the center of end 103 (FIG. 2) is approximately 1.5 inches out from the left spa side 32 of the spa 24. It should be noted that the stationary base 42 could be constructed as one continuous member, however, for purposes of shipping and handling, two separate right and left base members 46, 48 are employed.

For the purpose of pivotally supporting the pivot frame assembly 34, the left base member 48 includes a plastic pivot connector 106 sized and shaped to fit tightly over the end 103 of the left base member 48, i.e., at the end of the upward curve 102. In addition, the pivot connector 106 includes a set screw (not illustrated) to secure the same over the end 103. As will be more fully explained below, the pivot connector 106 defines a boss 108 which provides the pivot point for the pivot frame assembly 38. The boss 108 should be approximately 8.5 inches above the bottom of the spa base 36.

Turning now to FIG. 1, a pivot frame assembly 38 is illustrated linking the spa cover 22 to the stationary base 42. Because spas, and the covers therefor vary in size, the pivot frame assembly 38 is constructed of components that are adjustable to compensate for such size differences. For this purpose opposing right and left corner tubes 110, 112 are employed and rigidly held together by a sleeve tube 114. The sleeve tube 114 is square in cross section and is sized to tightly slip over the opposing right and left corner tubes 110, 112. As will be seen below, sheet metal screws are placed through the sleeve tube 114 into each corner tube 110, 112 to firmly prevent relative movement.

Directing attention again to FIG. 2, the outside end of left corner tube 112 is bent, as illustrated, to form a 90 degree curve to form an extended portion 118. The extended portion 118 is provided to receive a pivot collar 120 which includes a pair of spaced pivot mounts 122 and 124. The pivot mounts 122, 124 are so spaced to receive therebetween the boss 108 of the pivot connector 106. Importantly, pivot holes 126 and 128 are respectively provided through the boss 108 and the pivot mounts 122, 124. In this way, the pivot collar 120 can be pivotally connected to the boss via screw 130. Additionally, the pivot collar 120 is secured to the extended portion 118 by set screw 132.

Disposed over the extended portion 118, is a slightly larger slot tube 134. The slot tube 134 is formed from the square tube with a slot 136 formed the entire length in one face of the tube. In this way, the slot tube 134 can be secured to the extended portion 118 of left corner tube 112 by bolts 138 which are secured through holes (not illustrated) in the extended portion 118. This arrangement is best illustrated in FIG. 3 which shows a fender washer 140 urged by a bolt 138 against the slot tube 134 wherein the slot 136 enables the slot tube 134 to slide past the bolts 138 prior to the tightening thereof. Accordingly, the slot tube 134 is firmly secured to the extended portion 118 of corner tube 112.

Turning again to FIG. 2, at the opposing end of the slot tube 134, a side arm 40 is similarly fixed thereto, within the slot tube 134, by bolts 144, 146 which include fender washers 140. Importantly, the side arm 40 is the component that is coaxially adjusted along slot tube 134 to compensate for size variations of spas and the covers therefor.

At the exposed end of the side arm 40, a pivot connection fitting 148 is secured within the end of side arm 40 by a machine type screw 150. Additionally, the pivot connection fitting 148 includes a connection member 152 that extends outward to define a hole 154 which is employed for attachment of the side arm 40 to a side hinge bracket 156. More specifically, a side hinge bracket 156 is fixed to the spa cover 22, on the left cover side surface 26 at a point approximately 27 inches from the back thereof. For this purpose, a pre-positioned metal plate (not illustrated) is incorporated in the spa cover 22 during its manufacture. The metal plate provides the anchor point for the side hinge bracket 156. Importantly, the side hinge bracket 156 provides the point of attachment of the pivot frame assembly 38 to the spa cover 22.

Accordingly, sheet metal screws 158 are employed through each hole provided in the side hinge bracket 156. As noted above, the pivot connection fitting 148 includes a connection member 152 having a hole 154. The hole 154 is provide to receive therethrough a center screw 160 which is disposed for attachment to a center post 162 located on the side hinge bracket 156. In this way, the spa cover 22 can be supported by the side arm 40, and freely pivot in relation thereto. Additionally, a ½ inch spacer 164 is provided between the side hinge bracket 156 and the spa cover 22. The spacer 164 properly positions the side hinge bracket 156 in relation to the spa thereby providing clearance between the side arm 40 and the spa 24 as well as positioning both side arms such that they will pivot in parallel planes. Of course, as noted above the right side of the spa cover removal apparatus is constructed as the mirror image of the left side.

Figure 5:
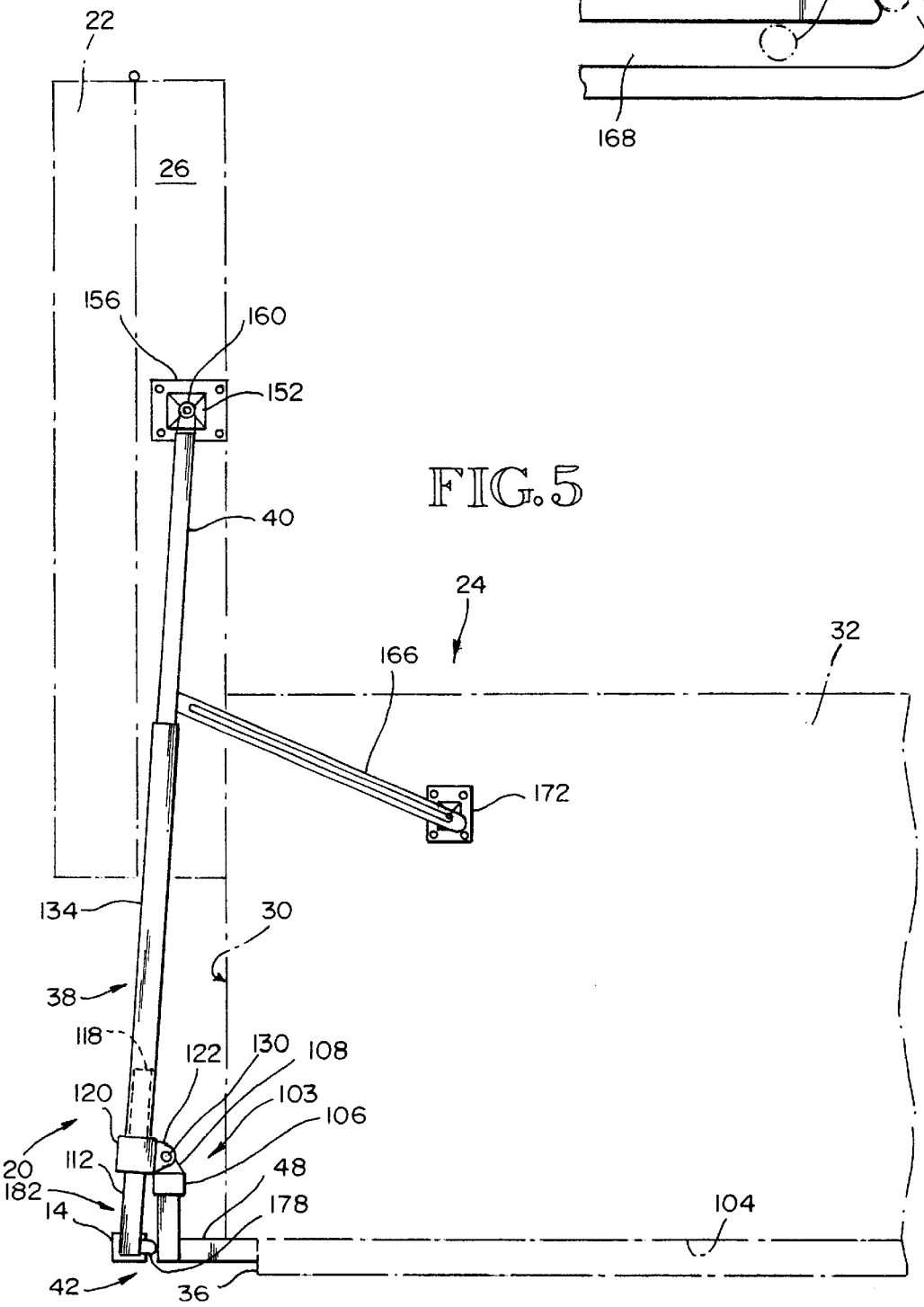
FIG. 5 is a left side elevation view of a spa cover removal apparatus installed on a spa with a spa cover disposed in the second stowed position adjacent the back surface of the spa.

Directing attention to FIGS. 4 and 5, operation of the spa cover removal apparatus 20 is illustrated. FIG. 4 shows the spa cover 22 covering the spa 24, while FIG. 5 shows a fully retracted spa cover 22. Accordingly the spa cover 22 shifts from a first horizontal covering position over the spa, to a second stowed position adjacent the back side of the spa as a rearwardly directed force is increasingly applied to the spa cover 22 causing the same to move rearward and pivot relative to the side arms while the pivot frame assembly 38 simultaneously pivots relative to the stationary base 42, about a substantially horizontal base pivot axis 44.

In order to prevent the pivot frame assembly 38 from over-pivoting, a slide lock bar 166 is provided as illustrated in FIGS. 1 through 6. The slide lock bar 166 is constructed from solid metal bar and includes a slot 168. The slide lock bar 166 is connected to the side arm 40 by a common bolt 144 wherein a bearing 170 is disposed to separate the bolt 144 from the slot 168. For proper placement, the slide lock bar 166 is installed while the spa cover 22 is in the second stowed position.

Specifically, when the slide lock bar 166 is fully extended as shown in FIG. 5, a slide hinge bracket 172, having a center screw 174, is bolted to the left spa side 32, at the far end of the slide lock bar 166. Typically, a ¼ inch spacer 173 is placed behind the slide hinge bracket 172. The slide lock bar 166 is then attached to the slide hinge bracket 172 via the center screw 174, bearing 170 and washer 140 being placed with the bearing 170 extending through the slot 168. In this way, the spa cover 22 is prevented from extending any further in back of the spa 24. However, with this arrangement, the spa cover 22 can be returned to the first horizontal covering position over the spa 24 as illustrated in FIG. 4.

Figure 6:
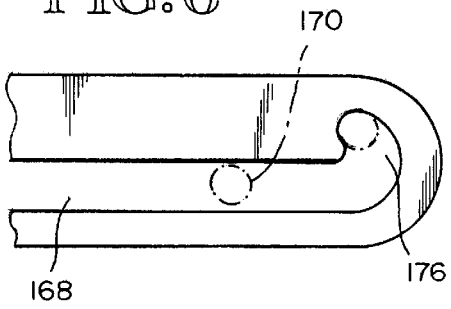
FIG. 6 is a fragmentary side elevation view of a slide lock bar illustrating a slide groove extending to the locking groove.

Another feature of the slide lock bar 166, is that a locking groove 176 is provided as illustrated in FIG. 6, at the far end of the slide lock bar 166. The locking groove 176 is so provided to lock the slide lock bar 166, and so the spa cover 22, in place when the spa cover 22 is in the second stowed position. As can be seen, as the spa cover 22 is moved rearward, the slide lock bar 166 becomes fully extended, wherein gravity causes the locking groove 176 to engage the bearing 170. In order to return the spa cover 22 to the first covering position, the user lifts the slide lock bar 166 while urging the spa cover 22 forward.

In addition to the slide lock bar 166, the pivot frame assembly 38 is also prevented from over extending in the rearward direction by an extended portion 182 thereof. Specifically, an extended portion 182 of the pivot frame assembly 38 extends in a downward direction from the base pivot axis 44, in an opposing direction from the side arms, to engage the stationary base 42 when the spa cover 22 is moved to the second stowed position. In this way, further pivotal movement of the pivot frame assembly 38 is restricted from further pivotal movement when the spa cover moves to the second stowed position. Further, a bump stop 178 is attached to the right and left corner tube 110, 112 as illustrated in FIGS. 2, 4 and 5. The bump stop 178 is made from a flexible material such as rubber, to soften the stopping point of the spa cover 22 as it is moved to the second stowed position as the pivot frame assembly 38 engages the stationary base 42.

As an alternate embodiment, it should be understood that the left and right base members could be configured so that the installation thereof is along the left and right spa sides 32, 34. Turning to FIG. 1, this configuration is illustrated by base member 180.

Additionally, another alternate embodiment (not illustrated) would have the side arms curve slightly inward, toward the spa, to compensate for an overly narrow spa cover. This configuration is sometimes required where a spacer placed behind a side hinge bracket would have to be too large.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A spa cover removal apparatus for assisting in the repositioning and removal of a spa cover having opposing left and right cover side surfaces, from a spa of the type having a back side disposed between opposing left and right spa sides, the spa cover removal apparatus comprising:

a pivot frame assembly having a pair of elongate side arms spaced apart and adapted to receive the opposing cover side surfaces between the same for rotatably supporting the spa cover; and a stationary base formed of at least one elongated tubular base member disposed under the pivot frame assembly and adapted to be fixed to the spa for pivotally supporting the pivot frame assembly wherein the spa cover shifts from a first horizontal covering position over the spa, to a second stowed position adjacent the back side of the spa as a rearwardly directed force is applied to the spa cover causing the same to move rearward and rotate relative to the side arms while the pivot frame assembly simultaneously pivots relative to the stationary base, about a substantially horizontal base pivot axis and wherein a portion of the pivot frame assembly extends in a downward direction from the base pivot axis, in an opposing direction from the side arms, for engagement with the stationary base for restricting further pivotal movement of the pivot frame assembly when the same moves to the second stowed position.

2. A spa cover removal apparatus as recited in claim 1 further comprising a slide lock bar extending from the pivot frame assembly for sliding attachment to one of the spa sides to restrict the spa cover against further movement once the same reaches the second stowed position.

3. A spa cover removal apparatus as recited in claim 2 wherein the slide lock bar further comprises a locking groove disposed at one end of a slot for engagement with a bearing to prevent movement of the pivot frame assembly when the spa cover reaches the second stowed position.

4. A spa cover removal apparatus as recited in claim 1 wherein the side arms are arranged to rotatingly engage one of the spa cover side surfaces reinforced with an integrally disposed metal plate.

5. A spa cover removal apparatus as recited in claim 1 wherein each side arm employs a side hinge bracket for rotating engagement with one of the spa cover side surfaces reinforced by a metal plate integrally disposed therein.

6. A spa cover removal apparatus as recited in claim 1 wherein the distance between the side arms is adjustable.

7. A spa cover removal apparatus as recited in claim 1 wherein the distance from the base pivot axis to one of the cover side surfaces is adjustable.

8. A spa cover removal apparatus as recited in claim 1 wherein the stationary base is disposed adjacent a recessed spa base.

9. A method of making a spa cover removal apparatus for assisting in the repositioning and removal of a spa cover having opposing left and right cover side surfaces, from a spa of the type having a back side disposed between opposing left and right spa sides, the method comprising the steps:

providing a pivot frame assembly having a pair of elongate side arms spaced apart to receive opposing cover side surfaces between the same for rotatably supporting the spa cover;

arranging a stationary base formed of at least one elongated tubular base member for placement under the pivot frame assembly, so that the stationary base can be fixed to the spa for pivotally supporting the pivot frame assembly wherein the spa cover shifts from a first horizontal covering position over the spa, to a second stowed position adjacent the back side of the spa as a rearwardly directed force is applied to the spa cover causing the same to move rearward and rotate relative to the side arms while the pivot frame assembly simultaneously pivots relative to the stationary base, about a substantially horizontal base pivot axis; and extending a portion of the pivot frame assembly in a downward direction from the base pivot axis, in an opposing direction from the side arms, for engagement with the stationary base for restricting further pivotal movement of the pivot frame assembly when the same moves to the second stowed position.

10. A method of making a spa cover removal apparatus as recited in claim 9 further comprising the step of extending a slide lock bar from the pivot frame assembly for sliding attachment to one of the spa sides to restrict the spa cover against further movement once the same reaches the second stowed position.

11. A method of making a spa cover removal apparatus as recited in claim 10 further comprising the step of forming an elongated slot in the slide lock bar for sliding engagement with a bearing that extends outward from the one spa side.

12. A method of making a spa cover removal apparatus as recited in claim 11 further comprising the step of forming a locking groove disposed at one end of the slot for engagement with the bearing to prevent movement of the pivot frame assembly when the spa cover reaches the second stowed position.

13. A method of making a spa cover removal apparatus as recited in claim 9 wherein the distance between the side arms is adjustable.

14. A spa cover removal apparatus for assisting in the repositioning and removal of a spa cover having opposing left and right cover side surfaces, from a spa of the type having a back side disposed between opposing left and right spa sides, the spa cover removal apparatus comprising:

a pivot frame assembly having a pair of elongate side arms spaced apart and adapted to receive the opposing cover side surfaces between the same for rotatably supporting the spa cover;

a stationary base formed of at least one elongated tubular base member disposed under the pivot frame assembly and adapted to be fixed to the spa for pivotally supporting the pivot frame assembly wherein the spa cover shifts from a first horizontal covering position over the spa, to a second stowed position adjacent the back side of the spa as a rearwardly directed force is applied to the spa cover causing the same to move rearward and rotate relative to the side arms while the pivot frame assembly simultaneously pivots relative to the stationary base, about a substantially horizontal base pivot axis; and a slide lock bar extending from the pivot frame assembly for sliding attachment to one of the spa sides to restrict the spa cover against further movement once the same reaches the second stowed position.

15. A spa cover removal apparatus as recited in claim 14 wherein the slide lock bar comprises an elongated slot for sliding engagement with a bearing that extends outward from the one spa side.

16. A spa cover removal apparatus as recited in claim 15 wherein the slide lock bar further comprises a locking groove disposed at one end of the slot for engagement with the bearing to prevent movement of the pivot frame assembly when the spa cover reaches the second stowed position.

17. A spa cover removal apparatus as recited in claim 14 wherein a portion of the pivot frame assembly extends in a downward direction from the base pivot axis, in an opposing direction from the side arms, to engage the stationary base for restricting further pivotal movement of the pivot frame assembly when the same moves to the second stowed position.

18. A spa cover removal apparatus as recited in claim 17 wherein the portion of the pivot frame assembly that extends in a downward direction from the base pivot axis is adjustable.

19. A spa cover removal apparatus as recited in claim 14 wherein the distance between the side arms is adjustable.

20. A spa cover removal apparatus as recited in claim 14 wherein the distance from the base pivot axis to one of the cover side surfaces is adjustable.

* * * * *